US007177579B2

(12) United States Patent
Uchida et al.

(10) Patent No.: US 7,177,579 B2
(45) Date of Patent: Feb. 13, 2007

(54) IMAGE HEATING APPARATUS

(75) Inventors: Michio Uchida, Susono (JP); Toru Saito, Mishima (JP); Atsutoshi Ando, Yokohama (JP); Tomoo Akizuki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 10/993,439

(22) Filed: Nov. 22, 2004

(65) Prior Publication Data

US 2005/0123329 A1 Jun. 9, 2005

(30) Foreign Application Priority Data

Nov. 27, 2003 (JP) ..... 2003-397678
Nov. 12, 2004 (JP) ..... 2004-328926

(51) Int. Cl.
*G03G 15/20* (2006.01)

(52) U.S. Cl. ..... 399/328; 219/216; 399/329

(58) Field of Classification Search ..... 399/328, 399/329, 330, 333; 347/156; 118/60; 219/216, 219/243; 492/46; 432/59, 60
See application file for complete search history.

(56) References Cited

U.S. PATENT DOCUMENTS 5,267,005 A * 11/1993 Yamamoto et al. ..... 399/329
5,355,204 A 10/1994 Aoki ..... 399/329
5,420,679 A 5/1995 Goto et al. ..... 399/335
5,493,380 A 2/1996 Saitou et al. ..... 399/328
5,499,087 A * 3/1996 Hiraoka et al. ..... 399/329
5,525,775 A 6/1996 Setoriyama et al. ..... 219/216
5,745,833 A 4/1998 Abe et al. ..... 399/330
6,049,691 A 4/2000 Abe et al. ..... 399/330
6,383,628 B2 5/2002 Abe et al. ..... 428/334
6,438,349 B2 8/2002 Ando ..... 399/333
6,556,806 B2 4/2003 Tsuruya et al. ..... 399/322
6,775,509 B2 8/2004 Shida et al. ..... 399/328
2004/0033084 A1 2/2004 Akizuki et al. ..... 399/69
2004/0081491 A1 4/2004 Uchida et al. ..... 399/328
2004/0105693 A1 6/2004 Akizuki et al. ..... 399/69
2004/0197112 A1 10/2004 Saito et al. ..... 399/69

FOREIGN PATENT DOCUMENTS

JP 3-233586 10/1991
JP 4-44075 2/1992
JP 05-088571 A * 4/1993
JP 8-6409 1/1996
JP 8-54795 2/1996
JP 8-286533 11/1996
JP 9-114292 5/1997
JP 9-197864 7/1997
JP 2001-194937 7/2001
JP 2003-228246 8/2003

* cited by examiner

*Primary Examiner*—Sophia S. Chen
(74) *Attorney, Agent, or Firm*—Fitzpatrick, Cella, Harper & Scinto

(57) ABSTRACT

An image heating apparatus has a flexible rotatable member, a slidable member contacting an internal surface of the flexible rotatable member, a holder for holding the slidable member, and a pressure roller for applying a pressure to the flexible rotatable member thereby forming a nip portion with the slidable member. A holding surface of the holder includes a first holding area of a crowned shape, and a second holding area of a crowned shape, which is provided at a downstream side of the first holding area in a moving direction of the flexible rotatable member, and the second holding area has a crown amount larger than a crown amount of the first holding area.

22 Claims, 9 Drawing Sheets

IMAGE HEATING APPARATUS

BACKGROUND OF THE INVENTION

1. Field of the Invention

The present invention relates to an image heating apparatus, adapted for use as a heat fixing apparatus for an image fixation of a recording medium bearing a toner image.

2. Related Background Art

In an image forming apparatus such as a printer or a copying apparatus, image formation is often executed by an electrophotographic process, and, in such process, a toner image is formed on a recording medium by a transfer method or a direct method, and is fixed by applying heat and pressure to such recording medium.

An image heating apparatus serving as a fixing apparatus for heat fixing the toner image has conventionally employed a heat roller system as shown in FIG. 6. This system is basically constituted of a heat roller 102 of a metallic material or the like provided therein with a heater 101, and an elastic pressure roller 103 pressed thereto, and a recording medium S bearing an unfixed toner image is introduced into a nip portion N (fixing nip) of the rollers 102, 103, and pinched and passed therein to heat the toner image t under heating and pressure.

However the fixing apparatus of such heat roller type requires a very long time for elevating the roller surface to a fixing temperature, because of a large heat capacity of the roller. For this reason, in order to achieve a prompt image outputting operation, the roller surface has to be controlled at a certain temperature even while the apparatus is not in use.

Therefore, Japanese Patent Application Laid-Open No. H04-44075 etc. propose an image heating apparatus of on-demand type of a configuration, in which a flexible sleeve (film) is employed in place for the highly rigid fixing roller and a heater is contacted with an internal surface of the sleeve, thereby forming a nip portion by the heater and the pressure roller, with the the flexible sleeve being therebetween.

Such image heating apparatus of on-demand type is generally constituted of a thin heat-resistant film (for example of polyimide), a heater (heat generating member) fixed at the side of a surface of the film, and a pressure roller provided at the side of the other surface of said film and opposed to the heater through the film for contacting a heated medium to the film.

When such apparatus is employed as a fixing apparatus, a recording medium is introduced into and passed by a nip portion (fixing nip) formed by a contact of the heater and the pressure roller through the film, whereby the recording medium is heated by the heater through the film to give the unfixed image with thermal energy, and whereby the toner image is fixed on the recording medium.

FIG. 7 is a schematic view showing a principal part of an image heating apparatus as explained above. A ceramic heater 113, constituting a heat generating member, is basically constituted of a thin oblong plate-shaped ceramic substrate having a longitudinal direction thereof perpendicular to the plane of the drawing, and a heat-generating resistor layer provided on a surface of the substrate, and is a heater of a low heat capacity showing a temperature increase over the entire surface with a steep start-up property by a current supply to the heat-generating resistor layer.

A holder 112 supports the heater 113. The holder 112 is a member formed by heat-resistant resin of a trough shape having a substantially semicircular cross section and having a longitudinal direction thereof perpendicular to the plane of the drawing. The heater 113 is fitted, with a heater surface thereof exposed downwards, in a groove formed on a lower face of the holder 112 and along the longitudinal direction thereof and fixed with a heat-resistant adhesive.

A cylindrical heat-resistant film 114 is loosely fitted around the holder 112 with the heater 113.

A pressurizing stay 111 is a rigid member having an inverted U-shaped cross section and a longitudinal direction perpendicular to the plane of the drawing. The pressurizing stay 111 is inserted in the holder 112.

An elastic pressure roller 115 serving as a pressurizing member is rotatably supported by bearings at both ends of a metal core. Above the pressure roller 115, an assembly of the heater 113, the holder 112, the film 114 and the stay 111 is positioned, with the heater 113 facing downwards, parallel to the pressure roller 115, and longitudinal ends of the pressurizing stay 111 are pressed downwards with urging members (not shown) to press the lower face of the heater 113 to urge it downward, through the film 114, to the upper surface of the pressure roller 115 against the urging means force of an elastic layer thereof, thereby forming a pressurized nip portion N of a predetermined width.

The pressure roller 115 is rotated clockwise as indicated by an arrow and with a predetermined peripheral speed by unillustrated driving means. By a pressurized frictional force at the pressurized nip portion N at the pressure roller 115 and the film 114 in the rotation of the pressure roller 115, a rotating force is exerted on the cylindrical film 114, which is thus driven counterclockwise as indicated by an arrow outside the holder 112, in sliding contact with the downward face of the heater 113.

In a state where the pressure roller 115 is rotated to also rotate the cylindrical film 114 and the heater 113 is energized, showing a rapid temperature increase and controlled at a predetermined temperature, a recording medium S bearing an unfixed toner image t is introduced between the film 114 and the pressure roller 115 at the pressurized nip portion N, in which the recording medium S, with a toner image bearing surface thereof in close contact with the external surface of the film 114, is pinched and conveyed together with the film 114. In the course of such conveying process, the recording medium S is heated by the heat of the film 114, which is heated by the heater 113, whereby the unfixed toner image t on the recording medium S is heat fixed thereto by heat and pressure. After passing the pressurized portion N, the recording medium S is separated by a curvature from the film 114 and is conveyed for discharge.

The image heating apparatus of the aforementioned film heating type, capable of employing a heater of a low heat capacity as the heating member, can achieve an electric power saving and a shorter wait time in comparison with the prior apparatus of a heat roller type or a belt heating type.

In such image heating apparatus of on-demand type, the heater 113 and the pressure roller 115 are mutually pressed by pressurizing both longitudinal ends of the pressurizing stay 111 and the pressure roller 115 with urging members such as spring. In such pressurizing configuration, even a slight bending in the pressure roller 115 or the pressurizing stay 111 tends to result in a situation where a pressure at a longitudinal center of the nip is smaller than a pressure at longitudinal ends of the nip. Such uneven pressure distribution renders the nip width, in the conveying direction of the recording medium, uneven over the longitudinal direction, thus often resulting in an uneven image fixing property. In order to compensate such unevenness in the nip width distribution, a heater holding surface of the holder 112 is made somewhat thicker in a longitudinal central portion than in both end portions, in such a shape that the heater 113 is bent and positioned closer to the pressure roller 115 in the longitudinal central portion than in both end portions (such shape being hereinafter called a crown shape).

Also in order to discharge the recording medium without creases, it is already known to form the pressure roller in an inversely crowned shape, namely a shape where the diameter is larger in both longitudinal end portions than in a central portion. In the pressure roller of such inversely crowned shape, the pressure roller has a peripheral speed larger in both ends portions than in the central portion, whereby the recording medium is subjected to a tensile force from the center to both ends in the conveying process through the pressurized nip portion. Such phenomenon is considered to suppress generation of creases.

However, a mechanism of suppressing crease generation on the recording medium does not necessarily depend only on the peripheral speed difference between the central portion and the end portions of the pressure roller. The aforementioned bending (crowning) of the heater 113 for compensating the unevenness in the nip with of the pressurized nip portion, if made excessively large, may cause creases in the discharged recording medium even if the pressure roller has an inversely crowned shape. An increasing crowning in the heater corresponds to an increase in the nip width (width in the conveying direction of the recording medium) at the longitudinal central portion of the nip. Thus the mechanism of suppressing crease generation on the recording medium is considered to depend not only on the peripheral speed difference between the central portion and the end portions of the pressure roller but also to be delicately related with the difference of the nip width between the longitudinal central portion and the end portions of the nip. In any case, an excessively large crowning of the heater is disadvantageous for crease formation in the recording medium.

On the other hand, in a portion immediately after being discharged from the pressurized nip portion N of the film 114 and the pressure roller 115, the recording medium S is released from a constriction by the pressurized nip portion N and shows a thermal dilatation as shown in FIGS. 8 and 9, thus generating undulations Sa in the conveying direction. In case such undulations are generated, a convex portion of such undulations contact the film 114 for a longer time, whereby a convex portion of the undulations Sa in the recording medium S tends to receive an excessive heat in comparison with a concave portion. Such undulations Sa are conspicuous in a resinous film such as an OHP sheet or a glossy film.

Particularly in case the film 114 is formed by a sleeve constituted of an elastic layer, a releasing layer and a metal film and having a certain heat capacity (for example a heat capacity per unit area is 0.1 $J/cm^2 \cdot K$), a convex portion in the undulations Sa generated in the recording medium S receives an excessive heat in comparison with a concave portion. Since such excessive heat deteriorate the surface smoothness in the convex portion, there will result, as shown in FIG. 9, a deteriorated transparency along the convex portion of the undulations Sa in case the recording medium S is an OHP sheet, or an unevenness in the luster in case the recording medium S is a glossy film. Such image unevenness seems to be appeared in the form of flames, hereinafter it is referred to as a fire mark.

Such fire mark tends to become more conspicuous in case the pressurized nip portion N, formed by the heater 113 and the pressure roller 115 across the film 114, has a small crown amount C in the longitudinal direction of the nip (for example C=100 μm for a nip length L=220 mm), and become less conspicuous as the crown amount C is larger (for example C=300 μm for a nip length L=220 mm). This is presumably because, as explained before, a small crown amount C of the pressurized nip portion N increases an ability of spreading the recording medium S during conveying in the pressurized nip portion N, thereby giving a larger stress to the recording medium S and enhancing the undulations Sa. However, in case of selecting a large crown amount C for giving an emphasis on the influence thereof on the fire mark, the ability of spreading the recording medium S during conveying in the pressurized nip portion N becomes lower whereby the creases become enhanced in a recording medium S of low stiffness such as a thin paper.

SUMMARY OF THE INVENTION

The present invention has been made in consideration of the aforementioned technical difficulties and an object thereof is to provide an image heating apparatus capable of suppressing creases and undulations in a recording medium.

Another object of the present invention is to provide an image heating apparatus including:

a flexible rotatable member;

a slidable member contacting an internal surface of said flexible rotatable member;

a holder for holding said slidable member; and a pressure roller for forming a nip portion in cooperation with said slidable member, with said flexible rotatable member being interposed;

wherein a holding surface of said holder includes a first holding area of a crowned shape in which a central portion in a longitudinal direction of said holder protrudes toward the nip portion more than both end portions in a longitudinal direction of said holder, and a second holding area of a crowned shape, which is provided at a downstream side of the first holding area in a moving direction of said flexible rotatable member and in which a central portion in a longitudinal direction of said holder protrudes toward the nip portion more than both end portions in a longitudinal direction of said holder; and wherein an amount of crown of the second holding area is larger than that of the first holding area.

Still another object of the present invention is to provide an image heating apparatus including:

a flexible rotatable member;

a slidable member contacting an internal surface of said flexible rotatable member;

a pressure roller for forming a nip portion in cooperation with said slidable member, with said flexible rotatable member being interposed; and urging means gives a pressure to form the nip portion;

wherein a shape of said slidable member, in a state pressurized by said urging means, is a crowned shape in which a central portion in a longitudinal direction of said slidable member protrudes toward the nip portion more than both end portions in a longitudinal direction of said slidable member, and an amount of crown of said slidable member at a downstream side of said slidable member in a moving direction of said flexible rotatable member larger than an amount of crown of said slidable member at a upstream side of said slidable member.

Still other objects of the present invention will become fully apparent from the following detailed description which is to be taken in conjunction with the accompanying drawings.

DESCRIPTION OF THE PREFERRED EMBODIMENTS (First Embodiment)

Figure 1:
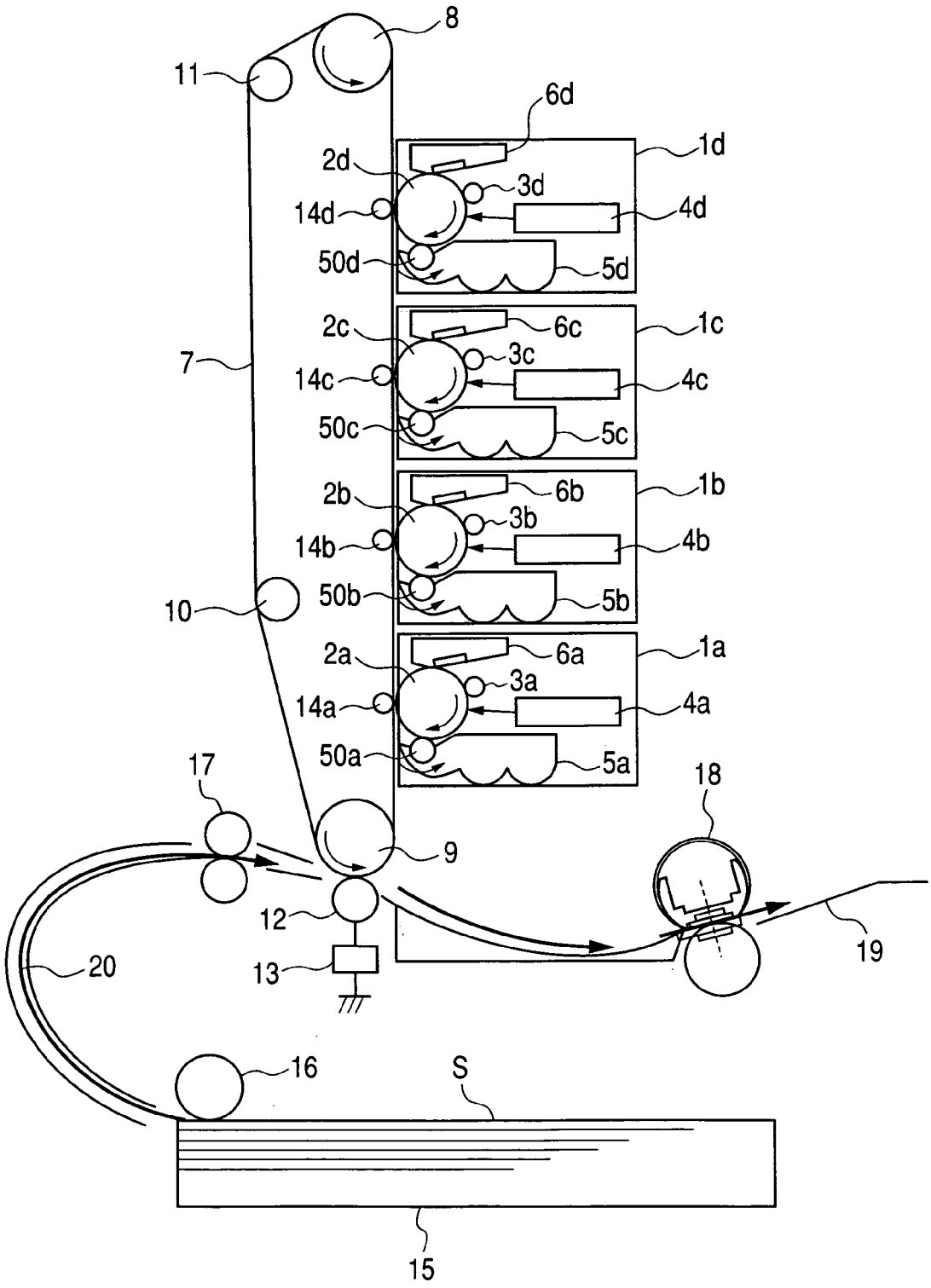
FIG. 1 is schematic view showing a configuration an image forming apparatus of an embodiment 1 of the present invention.
Figure 2:
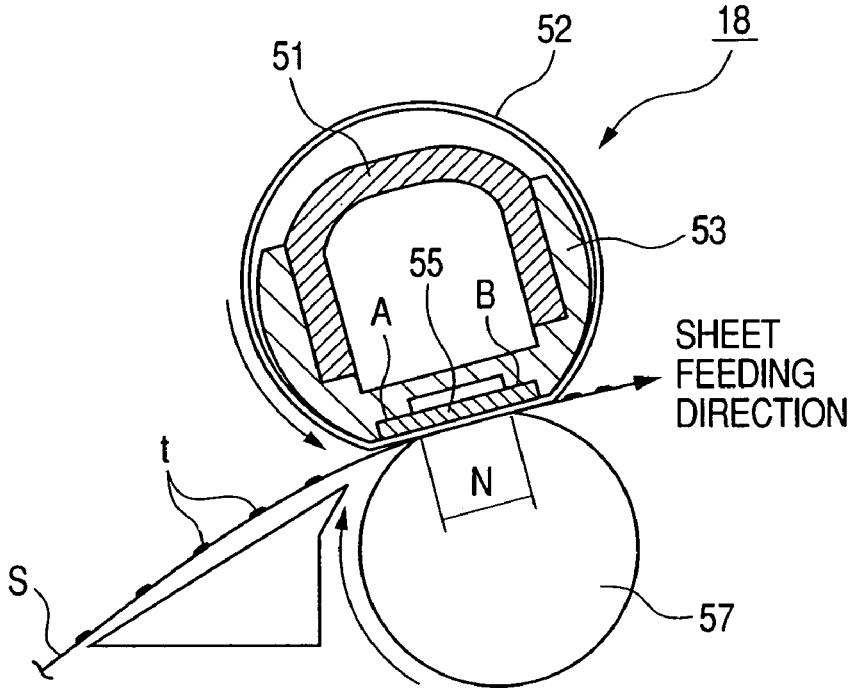
FIG. 2 is a schematic view showing a configuration of a fixing apparatus.

In the following, an embodiment of an image forming apparatus utilizing an image heating apparatus of the present invention as a fixing apparatus will be explained with reference to the accompanying drawings. FIG. 1 shows an example of the image forming apparatus, and FIG. 2 is a view showing a fixing apparatus. In the following there will be explained an entire configuration of the image forming apparatus and then a configuration of the fixing apparatus.

(1) Image Forming Apparatus

The image forming apparatus of the present embodiment is a full-color image forming apparatus utilizing an electrophotographic process, which is provided with four process stations 1*a* to 1*d* substantially provided in a line in a substantially vertical direction and respectively serving to form images of different colors (magenta, cyan, yellow and black), and a conveying path 20 for conveying a sheet S as a recording medium.

The process stations 1*a* to 1*d* includes at least photosensitive drums 2*a* to 2*d* for bearing latent images, and, around the photosensitive drums 2*a* to 2*d*, there are provided charging rollers 3*a* to 3*d* for uniformly charging the photosensitive drums 2*a* to 2*d*, exposure devices 4*a* to 4*d* for irradiating the photosensitive drums 2*a* to 2*d* for forming latent images, developing means 5*a* to 5*d* for developing the latent images formed on the photosensitive drums 2*a* to 2*d* with toners of respective colors (magenta, cyan, yellow and black) thereby forming visible images, and cleaning apparatuses 6*a* to 6*d* for removing residual toners on the photosensitive drums 2*a* to 2*d*.

The developing means 5*a* to 5*d* are provided with developing sleeves 50*a* to 50*d* for carrying toners. The developing sleeves 50*a* to 50*d* are supported with a predetermined gap to the corresponding photosensitive drums 2*a* to 2*d*, and, at a developing operation, a developing bias is applied between the photosensitive drums 2*a* to 2*d* and the developing sleeves 50*a* to 50*d*.

An intermediate transfer belt 7 is supported by a drive roller 8, an idler roller (driven roller) 9 and belt supporting rollers 10, 11, and is rotated in a direction indicated by an arrow in the drawing.

The intermediate transfer belt 7 is conveyed along a direction of array of the process stations 1*a* to 1*d*, and the toner images of respective colors on the photosensitive drums 2*a* to 2*d* are transferred, in the respective stations and in succession, by primary transfer means 14*a* to 14*d* onto the intermediate transfer belt thereby forming a full-color image.

On the other hand, sheets S are stacked in a sheet cassette 15 provided in a lower part of the apparatus, and are separated and fed one by one by a sheet feed roller 16 from the sheet cassette 15 and supplied via path 20 to paired registration rollers 17. The paired registration rollers 17 advances a fed sheet into a gap between the intermediate transfer belt 17 and a secondary transfer roller 12.

A surface in a lowermost part of the intermediate transfer belt 17 contacts a secondary transfer roller 12 so positioned as to be opposed to the idler roller 9, and the secondary transfer roller 12 pinches and conveys the passing sheet S in cooperation with the intermediate transfer belt 7. The secondary transfer roller 12 is given a bias from a high voltage source 13 (bias means), whereby the sheet S, passing between the secondary transfer roller 12 and the intermediate transfer belt, receives a secondary transfer of the toner image borne on the intermediate transfer belt, and is conveyed toward a fixing apparatus 18.

The sheet S, bearing the transferred toner image, is supplied to the fixing apparatus 18, and is heated and pressurized therein, whereby the toner image is fixed to the sheet S. In this manner an image is formed on the sheet S, which is then discharged from the fixing apparatus 18 to a discharge tray 19 outside the apparatus.

(2) Fixing Apparatus 18

Figure 7:
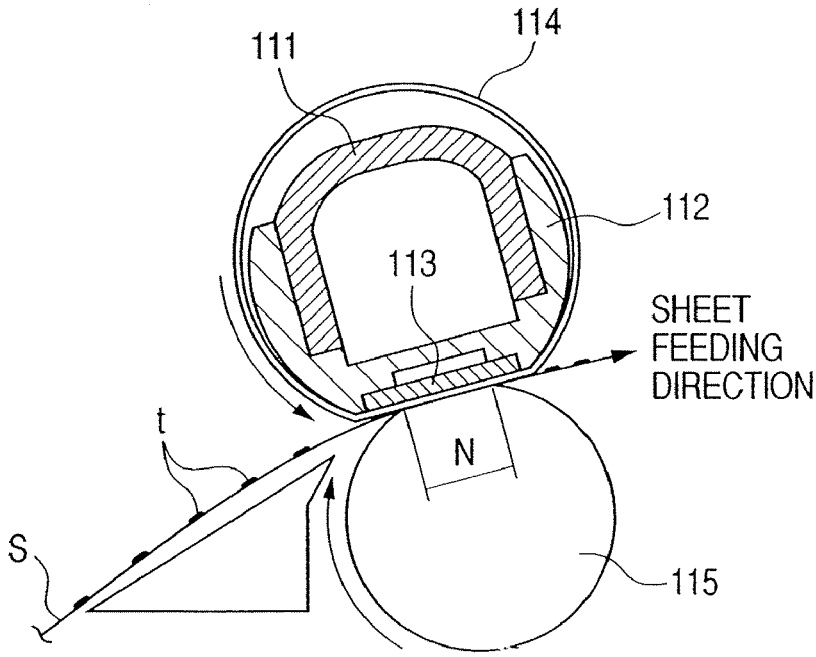
FIG. 7 PRIOR ART
FIG. 7 is a schematic view of a prior fixing apparatus of film heating type.

FIG. 2 is a schematic view showing the configuration of the fixing apparatus 18, which is an image heating apparatus of on-demand type basically same as the aforementioned fixing apparatus shown in FIG. 7.

The fixing apparatus is provided with a ceramic heater (slidable member) 55, a heater holder 53 for supporting the heater 55, a film-shaped fixing sleeve (flexible rotatable member) 52 wound around the holder 53, a reinforcing stay 51 constituted of a rigid member having an inverted U-shaped cross section, and a pressure roller 57 opposed to the heater 55 across the fixing sleeve 52. The ceramic heater 55 is formed by screen printing a paste of a heat generating resistor member on a rectangular ceramic substrate and patterning the heat-generating resistor member on the substrate. On the heat-generating resistor pattern, there is formed an insulating layer (glass layer) which is to contact an internal surface of the fixing sleeve. The pressure roller 57 has a structure of having an elastic layer on a metal core. The pressure roller 57 has an inversely crowned shape in which the diameter of the elastic layer is larger in both end portions in the longitudinal direction than in a central portion.

Figure 12:
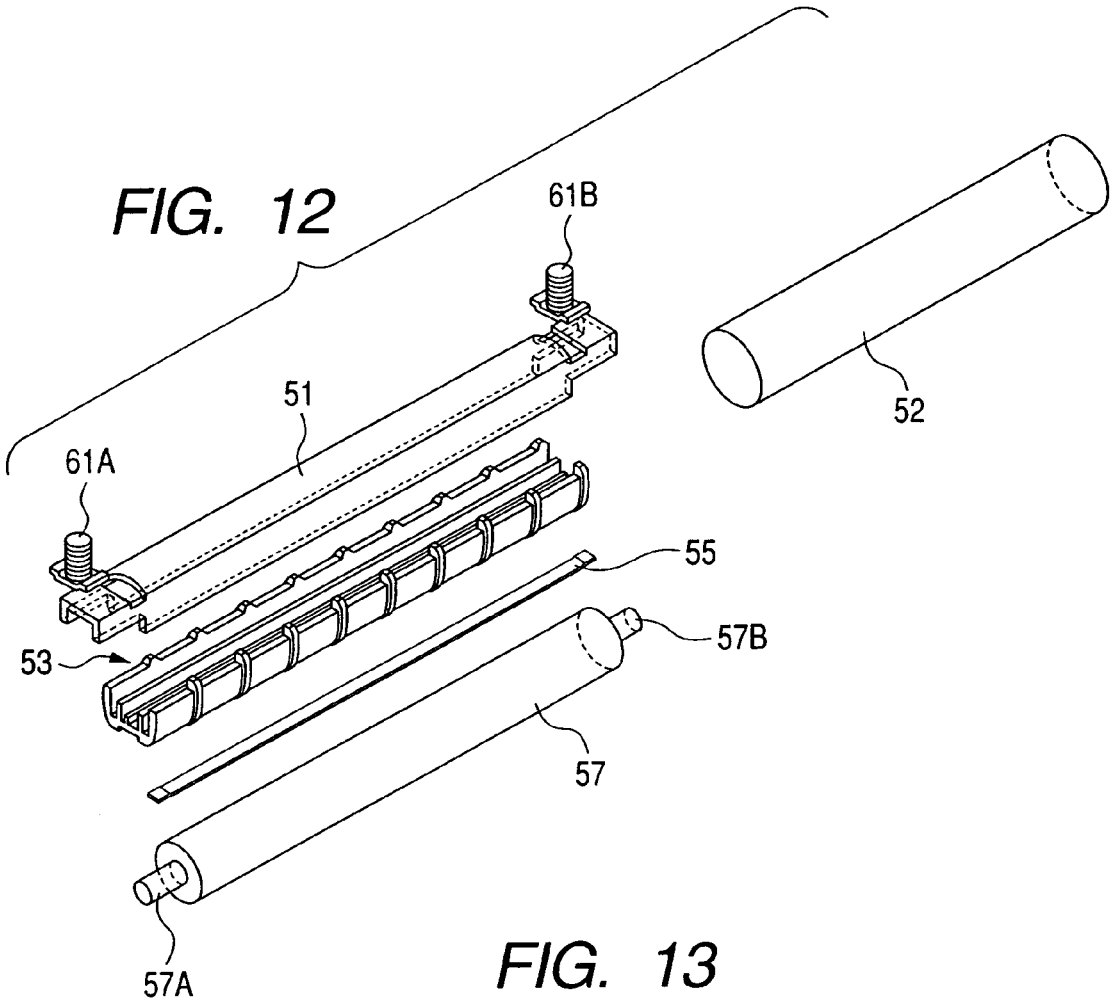
FIG. 12 is an exploded perspective view of a fixing apparatus of an embodiment 1.
Figure 13:
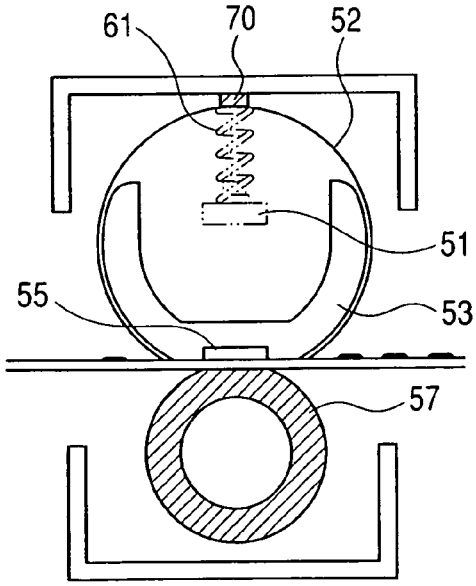
FIG. 13 is a view indicating a mode of spring application in the fixing apparatus of the embodiment 1.

Also as will be understood from an exploded view in FIG. 12 and a cross-sectional view in FIG. 13, a spring 61A (first bias means) and a spring 61B (second bias means) are provided between a main frame 70 of the fixing apparatus and the stay 51, and both bias the stay 51 toward the pressure roller 57. The urging means force of the springs 61A, 61B is transmitted from the stay 51 to the heater 55 through the holder 53. Also shafts 57A, 57B of the pressure roller 57 are rotatably supported on the main frame 70. Consequently a pressure by the springs 61A, 61B is applied between the heater 55 and the pressure roller 57, thereby forming a pressurized nip portion N.

A sheet S constituting a recording medium, passing through the pressurized nip portion N between the pressure roller 57 and the fixing sleeve 52, is pressed in the pressurized nip portion N and conveyed in a state in close contact with the fixing sleeve 52. Also by such pressing force, a rear surface of the heater is pressed to a receiving face (first holding area) A of the holder 53 at an upstream side of a sheet conveying direction, and also to a receiving face (second holding area) B at a downstream side. The holding surface of the holder 53 for holding the heater has a first holding area A and a second holding area B. Each of the receiving surfaces A, B has a crowned shape in which a longitudinal central portion protrudes more than both end portions towards the nip portion. The heater 55 is formed by a ceramic material, and has a substantially rectangular shape in a single component state not mounted on the apparatus. Such heater, when mounted on the apparatus and subjected to the force of the springs 61A and 61B, is bent along the crowned shape of the receiving faces A, B to form crowned shapes.

Figure 3:
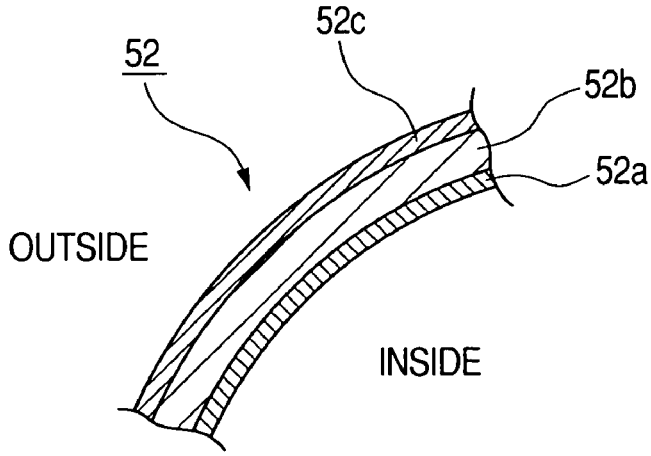
FIG. 3 is a schematic view showing a layered structure of a fixing sleeve.

In the present embodiment, the fixing sleeve 52, as shown in a schematic view of layered configuration in FIG. 3, is a flexible member constituted of a metal film 52*a*, an elastic layer 52*b* and a releasing layer 52*c* from the internal side. Also the fixing sleeve 52 has a heat capacity per unit area of about 0.1 $J/cm^2 \cdot K$.

In a state where the pressure roller 57 is rotated to also rotate the fixing sleeve 52 and the heater 55 is energized, showing a rapid temperature increase and controlled at a predetermined temperature, a sheet S constituting a recording medium and bearing an unfixed toner image t is introduced between the fixing sleeve 52 and the pressure roller 57 at the pressurized nip portion N, in which the sheet S, with a toner image bearing surface thereof in close contact with the external surface of the fixing sleeve 52, is pinched and conveyed together with the fixing sleeve 52. In the course of such conveying process, the sheet S is heated by the heat of the fixing sleeve 52, which is heated by the heater 55, whereby the unfixed toner image t on the sheet S is heat fixed thereto by heat and pressure. After passing the pressurized nip portion N, the sheet S is separated by a curvature from the fixing sleeve 52 and is conveyed for discharge.

Figure 4:
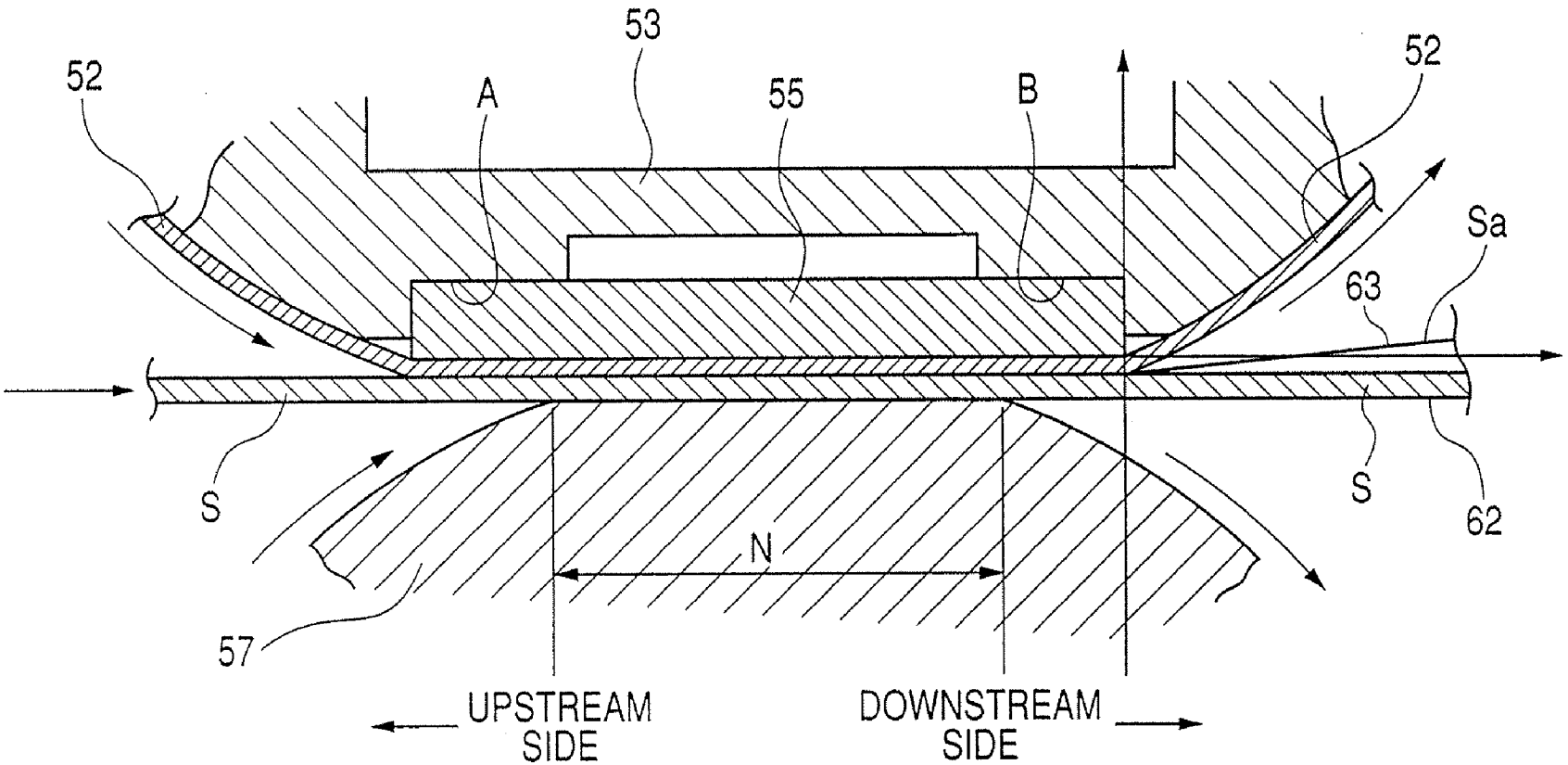
FIG. 4 is a partial magnified schematic view of a fixing apparatus.
Figure 8:
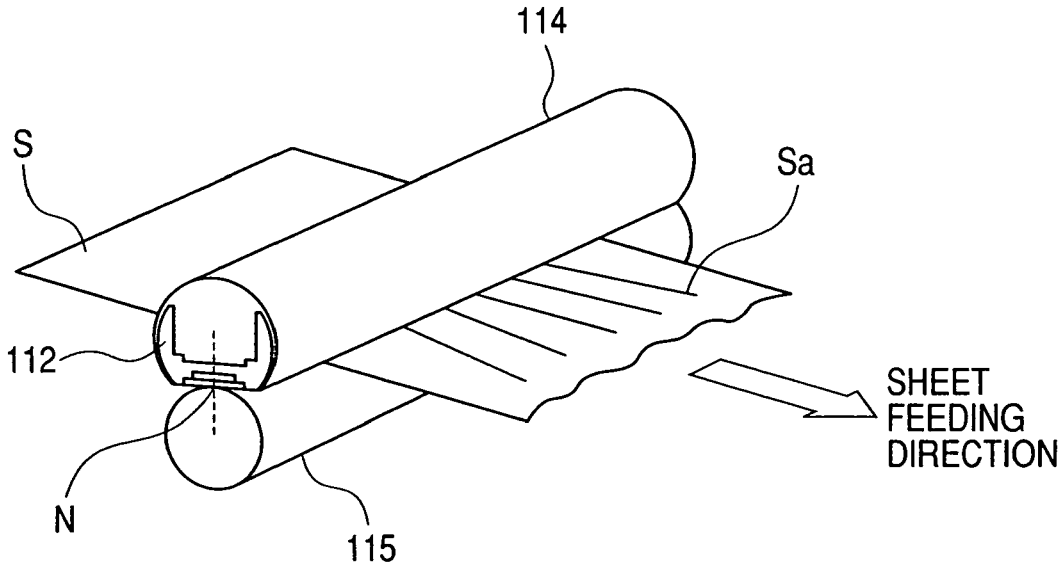
FIG. 8 is a perspective view schematically showing undulations of a recording medium.
Figure 9:
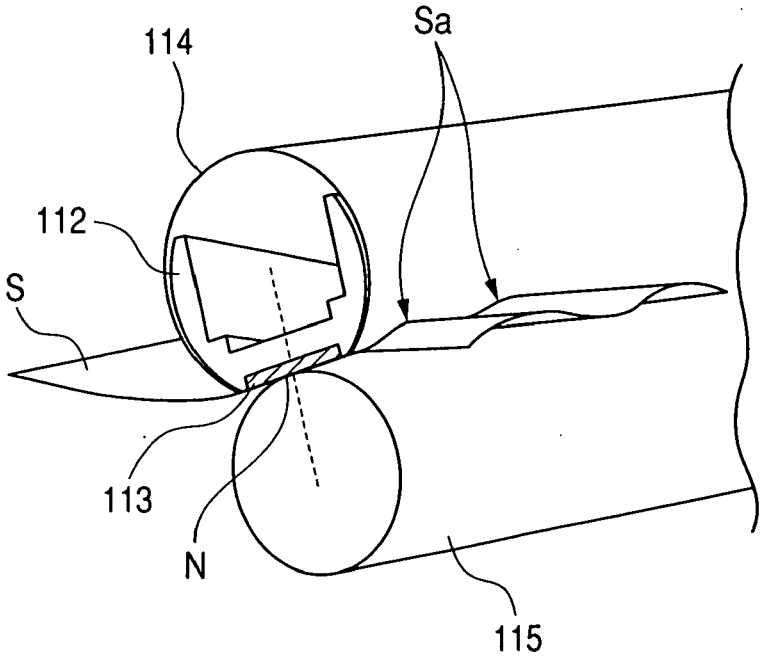
FIG. 9 is a schematic magnified view of FIG. 8.
Figure 10:
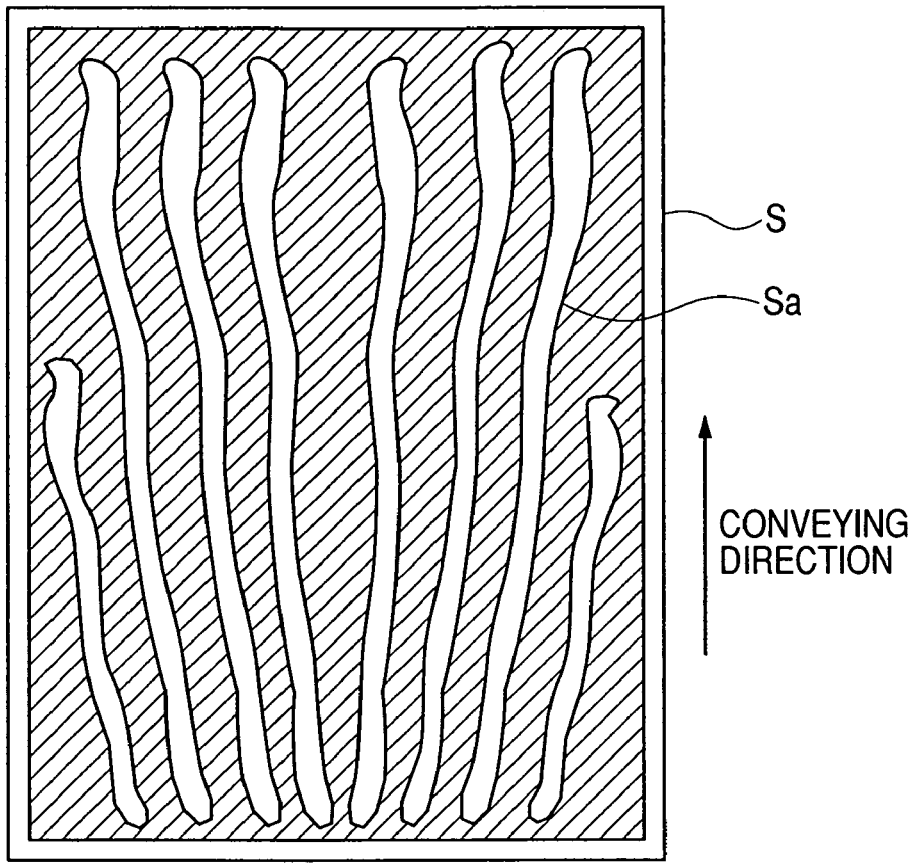
FIG. 10 is a view showing portions of image defects.

Immediately after being discharged from the pressurized nip portion N, the sheet S is released from a constriction by the pressurized nip portion N and shows a thermal dilatation. As shown in a magnified partial schematic view in FIG. 4 and also in FIGS. 8 and 9, the sheet S in the course of passing the pressurized nip portion is subjected, for example by an inverted crowned shape of the pressure roller, to a spreading force from a center toward both ends in a direction perpendicular to the conveying direction. The sheet S, under a conveying stress by such force, shows a thermal dilatation upon being discharged from the nip portion and released from the constriction therein, thus generating undulations Sa along the conveying direction. In such undulations, an upward convex line is represented as an upper end portion 63 of the undulation and a downward convex line is represented as a lower end portion 62 of the undulation. In such state, the upper end portion 63 of the undulation contacting longer with the fixing sleeve 52 tends to receive an additional heat in comparison with the lower end portion 62, thus resulting in an image defect as explained in the prior technology. Such defect, appearing in a shape of flames, is called fire mark, which appears more conspicuously when the recording medium S is an OHP sheet or a resinous film sheet.

Figure 11:
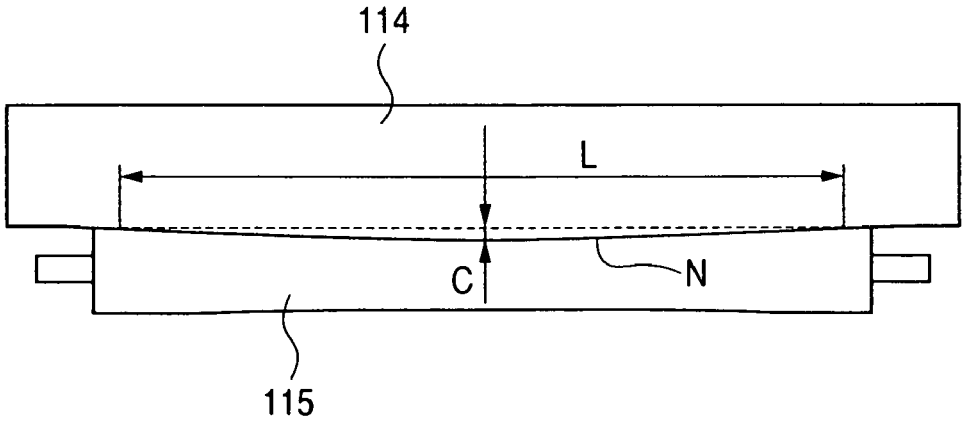
FIG. 11 is a view explaining a crown amount.

The fire mark is related in particular with the conveying stress on the sheet S when the sheet S is discharged from a downstream side of the pressurized nip portion N. The conveying stress is related with a crowned amount C provided along the longitudinal direction of the heater holder (FIG. 11). In order to prevent creases in the sheet while suppressing an uneven nip width distribution within the longitudinal direction of the pressurized nip portion N, when the heater receiving faces A, B of the holder 53 are given a crown amount for example of C=100 μm for L=220 mm (namely a relatively small crown amount), creases can be prevented but the fire mark becomes conspicuous. On the other hand, a crown amount effective for avoiding such image defect (fire mark) such as C=400 μm for L=220 mm (namely a relative large crown amount) reduces the effect of spreading the sheet within the nip portion, thereby generating creases in a sheet of low stiffness such as a thin paper. The aforementioned numerical values of the crown amount of the heater receiving faces A, B of the holder 53 correspond to an inverted crown amount $C_{pressure}$ of the pressure roller 57 for example of $C_{pressure}$=150 μm for L=220 mm.

It is found that the fire mark is particularly generated at the sheet discharge from the pressurized nip portion N, namely principally by a conveying stress caused by the crown amount at a downstream side within the pressurized nip portion N, while the sheet creases are generated in case a conveying function under sheet spreading is not exhibited satisfactorily immediately after the sheet S enters the pressurized nip portion (namely in an upstream side within the pressurized nip portion N).

Therefore, in the present embodiment, the crowned amount in the pressurized nip portion N constituted of the pressure roller 57, the fixing sleeve 52 and the holder 53 is made different in an upstream side and in a downstream side in the sheet conveying direction within the pressure nip portion N.

Figure 5:
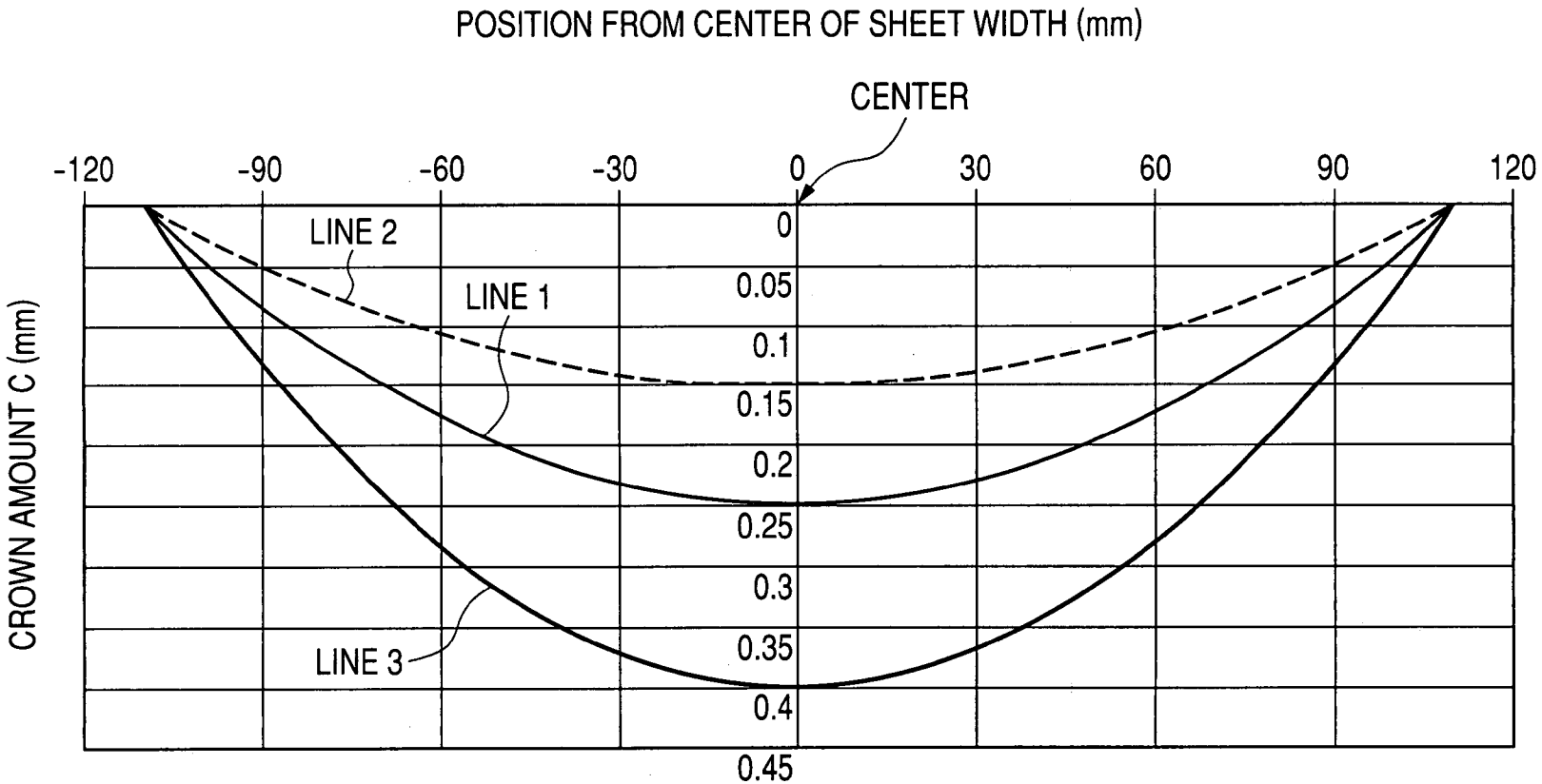
FIG. 5 is a chart showing shapes of a heater receiving faces A, B of a heater holder.
Figure 6:
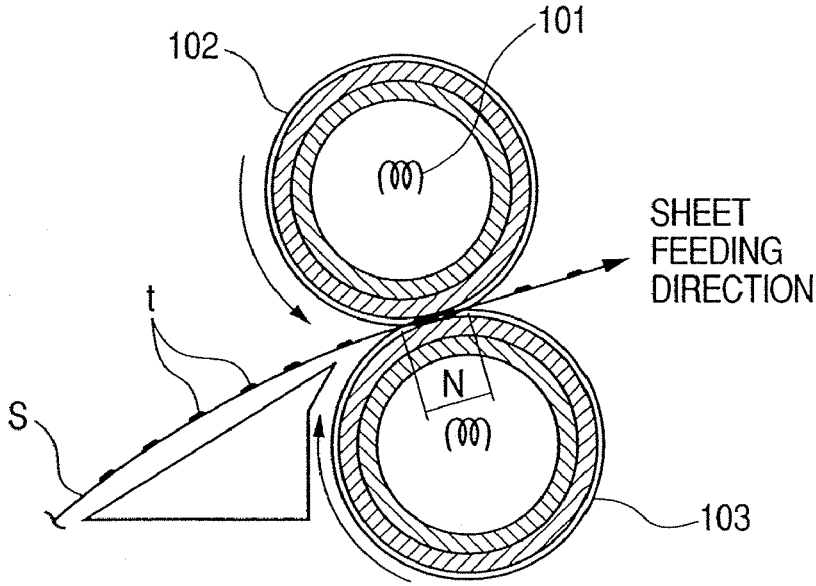
FIG. 6 PRIOR ART
FIG. 6 is a schematic view of a prior fixing apparatus of heat roller type.

FIG. 5 shows the difference in the crown shape between the upstream side and the downstream side. In FIG. 5, a line 1 indicates an ordinary crown shape (a crown amount of 250 μm in both faces A and B). A line 2 indicates a crown shape (a crown amount of 150 μm) of the face A, while a line 3 indicates a crown shape (a crown amount of 400 μm) of the face B. More specifically, as shown in FIG. 5, the crown amounts C of the heater receiving faces A and B of the heater holder 53 are set, for example, as $C_A$=100 μm for L=220 mm for the receiving face A and $C_B$=400 μm for L=220 mm for the receiving face B. Thus, the crown amount $C_B$ of the heat receiving face (second holding area) B is selected larger than the crown amount $C_A$ of the heat receiving face (second holding area) A. In the prior apparatus, these amounts are same in the faces A and B.

Figure 14:
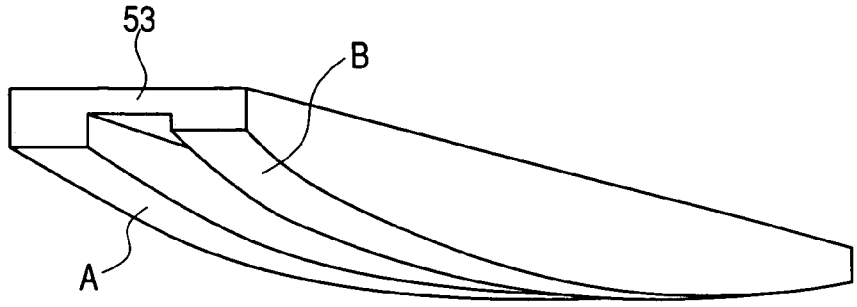
FIG. 14 is a perspective view, seen from obliquely below, of a part of the heater holder of the embodiment 1.
Figure 15:
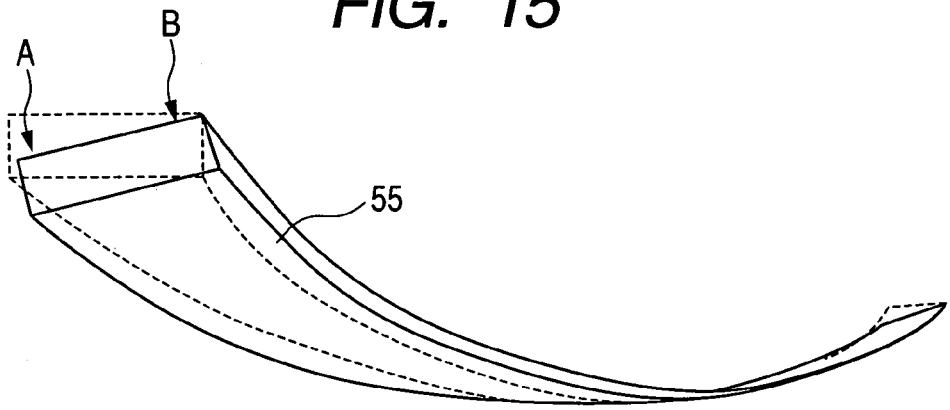
FIG. 15 is a perspective view, seen from obliquely below, of the heater in a state pressurized by springs.
Figure 16:
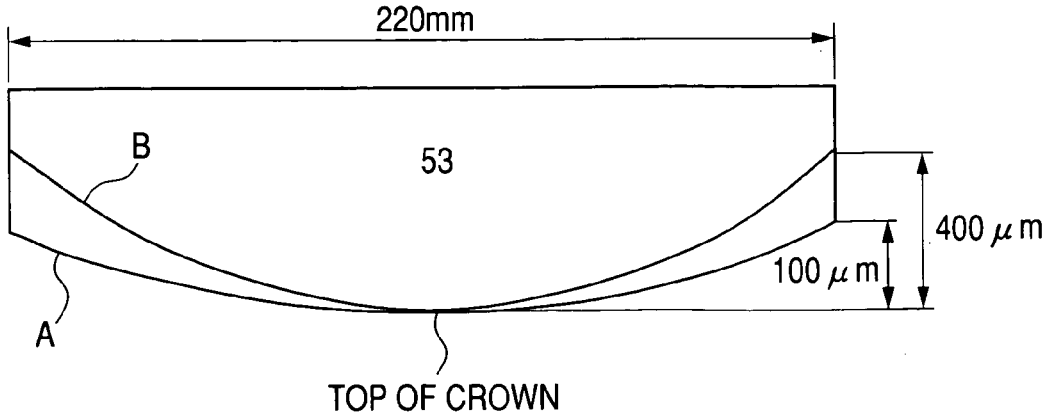
FIG. 16 is a view of a heater holder seen from a downstream side in a conveying direction of a recording medium.

FIG. 14 is a perspective view of a part of the heater holder 53 having the setting of the present embodiment, seen from obliquely below. Also FIG. 15 is a perspective view of the heater 55, seen obliquely below, in a state pressurized with the springs 61A, 61B with the heater holder 53 of a shape shown in FIG. 14. Further, FIG. 16 shows the heater holder seen from the downstream side in the conveying direction of the sheet S. As will be understood from FIGS. 14 and 16, the heater receiving face B has a crown amount ($C_B$=400 μm) larger than a crown amount ($C_A$=100 μm) of the heater receiving face A, but the heater receiving faces A and B are so shaped as to have apexes of a same height.

As will be apparent from the bending of the heater shown in FIG. 15, in case the heater receiving faces A, B have a same crown amount, the heater bends with a same crown amount in the upstream side and in the downstream side in the sheet conveying direction as indicated by a broken line in FIG. 15, but, in case the heater receiving face B has a larger crown amount than that of the heater receiving face A as in the present embodiment, the heater bends in such a manner that the crown amount in the downstream side in the sheet conveying direction (moving direction of the fixing sleeve) becomes larger than the crown amount in the upstream side as indicated by a solid line in FIG. 15.

In such configuration, a sheet S particularly of low stiffness such as a thin paper, immediately after entering the pressurized nip portion N, proceeds under a sufficient spreading toward both ends so that creases are not generated. Also the sheet S is discharged without an excessive stress immediately before the discharge, so that the amount of undulations immediately after the sheet discharge is limited whereby the fire mark can be suppressed.

It is thus possible to suppress the fire mark and the sheet creases at the same time, by separately setting, as explained in the foregoing, the crown amounts C for the heater receiving face A at the upstream side and for the heater receiving face B at the downstream side in the heater holder 53. However, an increase in the difference of the crown amounts C leads to an uneven nip width distribution in the longitudinal direction of the pressurized nip portion N. It is therefore important to select the crown amounts C for the heater receiving faces A, B in order to achieve a reduction in the fire mark, a reduction in the sheet creases and an uniform nip width distribution. Therefore experiments were conducted to find optimum crown amounts, and results are shown in Table 1.

TABLE 1

| upstream crown amount (μm) | downstream crown amount (μm) | sheet creases | fire mark | nip uniformity |
|---|---|---|---|---|
| 100 | 100 | Satisfactory | Poor | Satisfactory |
| | 200 | Satisfactory | Fair | Satisfactory |
| | 300 | Satisfactory | Satisfactory | Satisfactory |
| | 400 | Satisfactory | Satisfactory | Satisfactory |
| | 500 | Satisfactory | Satisfactory | Poor |
| | 600 | Satisfactory | Satisfactory | Poor |
| 200 | 200 | Satisfactory | Poor | Satisfactory |
| | 300 | Satisfactory | Fair | Satisfactory |
| | 400 | Satisfactory | Satisfactory | Satisfactory |
| | 500 | Satisfactory | Satisfactory | Poor |
| | 600 | Satisfactory | Satisfactory | Poor |
| 300 | 300 | Poor | Poor | Satisfactory |
| | 400 | Poor | Poor | Satisfactory |
| | 500 | Poor | Satisfactory | Satisfactory |
| | 600 | Poor | Satisfactory | Satisfactory |
| 400 | 400 | Poor | Poor | Satisfactory |
| | 500 | Poor | Poor | Satisfactory |
| | 600 | Poor | Satisfactory | Satisfactory |

Table 1 shows differences in the creases and the fire mark on the sheet S and the nip uniformity depending on the crown amounts of the heat receiving faces A, B, with evaluations:satisfactory, fair and poor. These experiments indicate that, with respect to the crown amounts in a direction perpendicular to the sheet conveying direction in the pressurized nip portion N, satisfactory states for the creases and the fire mark can be realized without deteriorating the uniformity of the nip width of the pressurized nip portion N by selecting a crown amount of 100 to 200 μm in the upstream portion A in the sheet conveying direction and a crown amount of 300 to 400 μm in the downstream portion. The heater 55 has a rectangular shape in a state prior to pressurization by the springs 61A, 61B (state of single component), and, being made of a ceramic material, does not necessarily assume the crown amounts same as those explained above of the heater 55. When the heater receiving face A is set at a crown amount $C_A$=100 to 200 μm and the heater receiving face B is set at a crown amount $C_B$=300 to 400 μm, the heater 55 shows an upstream crown amount $C_A'$ of 0 μm<$C_A'$≦100 μm and a downstream crown amount $C_B'$ of 200 μm≦$C_B'$≦200 μm, and these values are identified adequate for the crown amounts of the heater.

As explained in the foregoing, in a fixing apparatus equipped with a fixing sleeve constituted of an elastic layer, a releasing layer and a metal film, there can be provided a fixing apparatus not generating creases even in a thin paper and satisfactory against a fire mark. Also even with a fixing film of a relative large heat capacity, the fixing operation can be executed without deteriorating the image quality and generating the creases.

The foregoing embodiment employs a fixing film having a heat capacity per unit area of about 0.1 J/cm$^2$·K, but such example is not restrictive and there can also be employed for example a polyimide film of a very low heat capacity (for example a thickness of 50 μm and a heat capacity per unit area of 0.01 J/cm$^2$·K). In such case the upper end portion 63 and the lower end portion 62 of the undulations Sa show small difference in the receiving heat, thus giving a limited influence on the image quality, but the configuration of the present embodiment can provide a higher image quality. Also it can be applied to an apparatus equipped with a flexible fixing sleeve without the elastic layer.

In the present embodiment, the slidable member is constituted of a heater having a heat generating function, but it is only required to be capable of forming a nip portion in cooperation with the pressure roller and need not necessarily have such heat generating function. In such case, heat can be generated in the fixing sleeve itself for example by electromagnetic induction. Also in the present embodiment, the flexible movable member 52 is constituted of a cylindrical member which is rotated by the pressure roller, but there may be employed arbitrary rotating method such as providing a driving roller and a tension roller inside an endless film and rotating such driving roller thereby rotating the endless film.

The image heating apparatus of the present invention is usable not only as an image heat fixing apparatus as described in the embodiment but also applicable a temporarily fixing apparatus for temporarily fixing an unfixed image to a recording material, or a surface improving apparatus for reheating a recording material, bearing a fixed image, thereby improving a surface property such as luster of the image. It is naturally applicable also as an image heating apparatus for heating a heated member, such as a heat pressing apparatus for removing creases for example in a banknote, a heat laminating apparatus, a heat drying apparatus for evaporating moisture contained in paper or the like, an image heating apparatus for drying in an ink jet printer or the like.

The present invention is not limited to the aforementioned embodiments but includes any and all modifications within the technical concept of the invention.

This application claims priority from Japanese Patent Application Nos. 2003-397678 filed on Nov. 27, 2003 and 2004-328926 filed on Nov. 12, 2004, which are hereby incorporated by reference herein.

What is claimed is:

1. An image heating apparatus comprising:

a flexible rotatable member;

a slidable member contacting an internal surface of said flexible rotatable member;

a holder for holding said slidable member; and a pressure roller for forming a nip portion in cooperation with said slidable member, with said flexible rotatable member being interposed;

wherein a holding surface of said holder includes a first holding area of a crowned shape in which a central portion in a longitudinal direction of said holder protrudes toward the nip portion more than both end portions in a longitudinal direction of said holder, and a second holding area of a crowned shape, which is provided at a downstream side of the first holding area in a moving direction of said flexible rotatable member and in which a central portion in a longitudinal direction of said holder protrudes toward the nip portion more than both end portions in a longitudinal direction of said holder; and wherein an amount of crown of the second holding area is larger than that of the first holding area.

2. An apparatus according to claim 1, further comprising:

urging means gives a pressure to forming the nip portion;

wherein said urging means is provided on both end portions of a longitudinal direction of the apparatus.

3. An apparatus according to claim 2, further comprising:

a stay of a high rigidity for pressing said holder toward said pressure roller;

wherein first urging means urges an end portion of said stay toward said pressure roller and second urging means urges another end portion of said stay toward said pressure roller.

4. An apparatus according to claim 2, wherein said slidable member is a plate-shaped member, and is bent following shapes of the supporting faces of said holder by an effect of pressure by said urging means.

5. An apparatus according to claim 4, wherein said slidable member, in a state bent following the holding surfaces of said holder, shows a crown amount larger than zero and is equal to or less than 100 μm in an area corresponding to the first holding area of said holder, and a crown amount equal to or larger than 200 μm and is equal to or less than 300 μm in an area corresponding to the second holding area of said holder.

6. An apparatus according to claim 4, wherein said slidable member is formed by ceramics and has a substantially rectangular shape before pressurized by said urging means.

7. An apparatus according to claim 6, wherein said slidable member is a heater on which a heat generating resistor pattern is formed.

8. An apparatus according to claim 1, wherein the first holding area has a crown amount within a range from 100 to 200 μm, and the second holding area has a crown amount within a range from 300 to 400 μm.

9. An apparatus according to claim 1, wherein an apex of the crowned portion of the first holding area and an apex of the crowned portion of the second holding area have a substantially same height.

10. An apparatus according to claim 1, wherein said flexible rotatable member includes a base layer and an elastic layer.

11. An apparatus according to claim 10, wherein the base layer is constituted of a metal.

12. An apparatus according to claim 1, wherein said pressure roller has a diameter in both end portions in the longitudinal direction larger than a diameter in a central portion.

13. An image heating apparatus comprising:

a flexible rotatable member;

a slidable member contacting an internal surface of said flexible rotatable member;

a pressure roller for forming a nip portion in cooperation with said slidable member, with said flexible rotatable member being interposed; and urging means gives a pressure to form the nip portion;

wherein a shape of said slidable member, in a state pressurized by said urging means, is a crowned shape in which a central portion in a longitudinal direction of said slidable member protrudes toward the nip portion more than both end portions in a longitudinal direction of said slidable member, and an amount of crown of said slidable member at a downstream side of said slidable member in a moving direction of said flexible rotatable member larger than an amount of crown of said slidable member at a upstream side of said slidable member.

14. An apparatus according to claim 13, wherein said urging means is provided on both end portions of a longitudinal direction of the apparatus.

15. An apparatus according to claim 14, further comprising:

a holder for holding said slidable member and a stay of a high rigidity for pressing said holder toward said pressure roller;

wherein first urging means urges an end portion of said stay toward said pressure roller and second urging means urges another end portion of said stay toward said pressure roller.

16. An apparatus according to claim 15, wherein said slidable member is a plate-shaped member, and is bent following shapes of supporting faces of said holder by an effect of pressure by said urging means.

17. An apparatus according to claim 16, wherein said slidable member is formed by ceramics and has a substantially rectangular shape before mounting on the apparatus.

18. An apparatus according to claim 17, wherein said slidable member is a heater on which a heat generating resistor pattern is formed.

19. An apparatus according to claim 13, wherein said slidable member shows a crown amount larger than zero and is equal to or less than 100 μm in the upstream side, and a crown amount equal to or larger than 200 μm and is equal to or less than 300 μm in the downstream side.

20. An apparatus according to claim 13, wherein said flexible rotatable member includes a base layer and an elastic layer.

21. An apparatus according to claim 20, wherein the base layer is constituted of a metal.

22. An apparatus according to claim 13, wherein said pressure roller has a diameter in both end portions in the longitudinal direction larger than a diameter in a central portion.

* * * * *

UNITED STATES PATENT AND TRADEMARK OFFICE

CERTIFICATE OF CORRECTION

PATENT NO. : 7,177,579 B2
APPLICATION NO. : 10/993439
DATED : February 13, 2007
INVENTOR(S) : Michio Uchida et al.

It is certified that error appears in the above-identified patent and that said Letters Patent is hereby corrected as shown below:

COLUMN 1:
Line 26, “However” should read --However,--.

COLUMN 3:
Line 57, “deteriorate” should read --deteriorates--.
Line 63, “be appeared” should read --appear--.

COLUMN 4:
Line 53, “gives” should read --giving--.

COLUMN 5:
Line 3, “configuration” should read --configuration of--.
Line 44, “following” should read --following,--.

COLUMN 7:
Line 7, “Consequently” should read --Consequently,--.

COLUMN 10:
Line 5, “Also” should read --Also,--.
Line 28, “Also” should read --Also,--.
Line 44, “applicable” should read --applicable to--.

COLUMN 11:
Line 20, “gives a pressure to forming” should read --giving a pressure to form--.
Line 44, “pressurized” should read --being pressurized--.

UNITED STATES PATENT AND TRADEMARK OFFICE

CERTIFICATE OF CORRECTION

PATENT NO. : 7,177,579 B2
APPLICATION NO. : 10/993439
DATED : February 13, 2007
INVENTOR(S) : Michio Uchida et al.

It is certified that error appears in the above-identified patent and that said Letters Patent is hereby corrected as shown below:

COLUMN 12:
Line 12, "gives" should read --giving--.
Line 22, "a" should read --an--.

Signed and Sealed this

Seventh Day of August, 2007

JON W. DUDAS
*Director of the United States Patent and Trademark Office*